US009221259B2

(12) United States Patent
Tsujiuchi et al.

(10) Patent No.: US 9,221,259 B2
(45) Date of Patent: Dec. 29, 2015

(54) LIQUID EJECTION HEAD AND MANUFACTURING METHOD THEREOF

(71) Applicant: CANON KABUSHIKI KAISHA, Tokyo (JP)

(72) Inventors: Naoko Tsujiuchi, Kawasaki (JP); Satoshi Kimura, Kawasaki (JP); Naoki Nakajo, Yokohama (JP); Shimpei Yoshikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/722,005

(22) Filed: May 26, 2015

(65) Prior Publication Data

US 2015/0343776 A1 Dec. 3, 2015

(30) Foreign Application Priority Data

May 30, 2014 (JP) ..... 2014-112186

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2002/14491* (2013.01)

(58) Field of Classification Search
CPC ..... B41J 2/14; B41J 2/16; B41J 2/1623; B41J 2/1632; B41J 2/1637; B41J 2/14072; B41J 2/1601
USPC ..... 347/37, 47, 50, 86; 29/890.1
See application file for complete search history.

(56) References Cited

U.S. PATENT DOCUMENTS 8,201,923 B2 * 6/2012 Fujii ..... 347/47
8,262,204 B2 * 9/2012 Braun et al. ..... 347/85
8,573,741 B2 * 11/2013 Sharan et al. ..... 347/47

FOREIGN PATENT DOCUMENTS

JP 2012-142896 A 7/2012
JP 2012-143896 A 8/2012

* cited by examiner

*Primary Examiner* — An Do
(74) *Attorney, Agent, or Firm* — Canon U.S.A., Inc. IP Division

(57) ABSTRACT

A liquid ejection head includes a recording element substrate that ejects liquid; an electric wiring substrate electrically connected with the recording element substrate; a support member having a recess that houses the recording element substrate; and a sealant that seals an electric connection part between both the substrates. The support member has a projection-shaped adhesive application surface at a bottom surface of the recess, on which an adhesive for bonding the recording element substrate is applied; and a projection projecting from an inner side surface of the recess near the electric connection part toward the adhesive application surface, which has a first region that is covered with the recording element substrate, and a second region extending from the first region to the projection having a wall formed of the adhesive and closing a gap between the projection and a side surface of the recording element substrate facing the projection.

11 Claims, 10 Drawing Sheets

LIQUID EJECTION HEAD AND MANUFACTURING METHOD THEREOF

BACKGROUND OF THE INVENTION

1. Field of the Invention

The present invention relates to a liquid ejection head and a manufacturing method of the liquid ejection head.

2. Description of the Related Art

There is known a configuration of a liquid ejection head including a recording element substrate having an ejection opening group that ejects liquid represented by ink and an energy generating element facing each ejection opening. The liquid ejection head also includes a contact part that receives an electric signal and electric power to be used for driving the energy generating element from a recording apparatus body. The connection between the contact part and the recording element substrate typically uses an electric wiring member having flexibility.

A support member and a recording element substrate forming the liquid ejection head are joined by applying an adhesive to the support member and then aligning the position of the recording element substrate. The electric wiring member and the recording element substrate are electrically connected with each other by an inner lead provided at the electric wiring member and a connection terminal provided at the recording element substrate. An electric connection part between the inner lead and the connection terminal is covered with and protected by a sealant. Since this sealant has to quickly fill a narrow portion such as a gap of the electric connection part, a sealant with relatively low viscosity is typically used.

It is desirable that the sealant that covers the electric connection part does not contact a side surface of the recording element substrate as possible. One of the reasons is that the sealant may be expanded or shrunk due to a change in environment or other factor, and may apply an external force to the recording element substrate. In recent years, with the demand for downsizing a liquid ejection head, the distances among a plurality of ink supply openings provided at the recording element substrate, and the distance from the ink supply openings to an end of the recording element substrate are decreased. When an external force is applied from the sealant to such a recording element substrate, the recording element substrate may be deformed.

Owing to this, a technology to address the above-described problem is disclosed in Japanese Patent Laid-Open No. 2012-143896. Japanese Patent Laid-Open No. 2012-142896 discloses a liquid ejection head including a recording element substrate and a support member having a recess that houses this recording element substrate. The liquid ejection head has a projection at an inner side surface of the recess. The projection causes the distance to the recording element substrate to be partly decreased. When the recording element substrate is bonded to the support member, a wall is formed with the adhesive pressed by the recording element substrate and projects, between the recording element substrate and the projection. With this wall, extension of the sealant is restricted, and the sealant hardly contacts the recording element substrate.

In the liquid ejection head described in Japanese Patent Laid-Open No. 2012-143896, since the entire bottom surface of the recess is formed of a flat surface, the adhesive pressed by the recording element substrate extends to not only the wall formation portion (between the projection and the recording element substrate) but also the entire bottom surface of the recess isotropically. Hence, to ensure the height of the wall by a certain degree to restrict the extension of the sealant, the adhesive is required by a large amount. Also, since a region near the recording element substrate (projection) is partly provided within the recess, the applied adhesive may start to flow out from the region to the inner side surface of the recess, and the height (thickness) of the adhesive required for bonding the recording element substrate may not be ensured.

In recent years, in the liquid ejection head, the array of energy generating elements arranged on the recording element substrate tends to be elongated in order to increase the recording speed. Accordingly, if the recording element substrate is elongated, the bonding area between the recording element substrate and the support member is increased, and the adhesive is required by a larger amount.

SUMMARY OF THE INVENTION

According to an aspect of the invention, there is provided a liquid ejection head including a recording element substrate configured to eject liquid, the recording element substrate having a side surface; an electric wiring substrate configured to be electrically connected with the recording element substrate; a support member having a recess configured to house the recording element substrate, the recess having a bottom surface and an inner side surface; and a sealant configured to seal an electric connection part between the recording element substrate and the electric wiring substrate. The support member has a projection-shaped adhesive application surface formed at the bottom surface of the recess, an adhesive being applied to the adhesive application surface, the adhesive bonding the recording element substrate; and a projection projecting from the inner side surface of the recess near the electric connection part toward the adhesive application surface. The adhesive application surface has a first region configured to be covered with the recording element substrate, and a second region extending from the first region to the projection. The second region has a wall formed of part of the adhesive and configured to close a gap between the projection and the side surface of the recording element substrate facing the projection.

According to another aspect of the invention, there is provided a manufacturing method of a liquid ejection head. The liquid ejection head includes a recording element substrate configured to eject liquid, the recording element substrate having a side surface; an electric wiring substrate configured to be electrically connected with the recording element substrate; and a support member having a recess configured to house the recording element substrate, the recess having a bottom surface and an inner side surface, and a projection projecting from the inner side surface of the recess near an electric connection part between the recording element substrate and the electric wiring substrate toward the recording element substrate. The method includes applying an adhesive to a projection-shaped adhesive application surface formed at the bottom surface of the recess, the adhesive application surface has a first region configured to be covered with the recording element substrate, and a second region extending from the first region to the projection; pressing the adhesive applied to the first region by the recording element substrate, and forming a wall configured to close a gap between the projection and the side surface of the recording element substrate facing the projection with the adhesive pushed out from the first region by the pressing; and sealing the electric connection part with a sealant.

Further features of the present invention will become apparent from the following description of exemplary embodiments with reference to the attached drawings.

DESCRIPTION OF THE EMBODIMENTS

An embodiment of the invention is described below with reference to the drawings.

Figure 1:
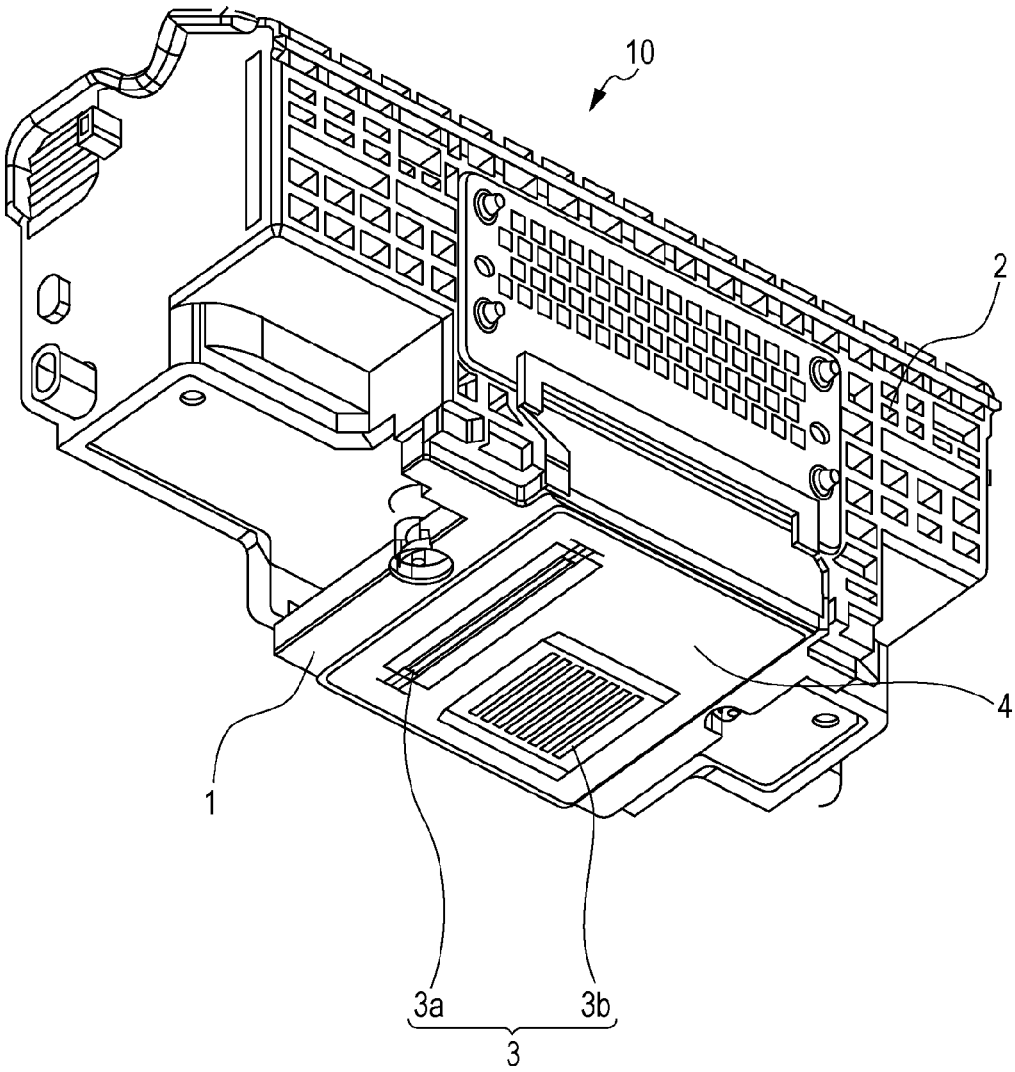
FIG. 1 is a perspective view of a liquid ejection head according to an embodiment of the invention.

FIG. 1 is a perspective view of a liquid ejection head according to the embodiment of the invention. A liquid ejection head 10 shown in FIG. 1 includes a support member 1, a housing 2 to which the support member 1 is attached, a recording element substrate 3 that is bonded to the support member 1, and an electric wiring member 4 (electric wiring substrate) that is electrically connected with the recording element substrate 3. In this embodiment, the recording element substrate 3 includes a recording element substrate 3*a* that ejects ink of black color, and a recording element substrate 3*b* that ejects ink of three colors except the black color. In the liquid ejection head 10, ink is supplied from a liquid supply part (not shown) that is connected with the housing 2 to the recording element substrates 3*a* and 3*b* through the housing 2 and the support member 1. The supplied ink is ejected by driving the recording element substrates 3*a* and 3*b* through the electric wiring member 4.

Figure 2:
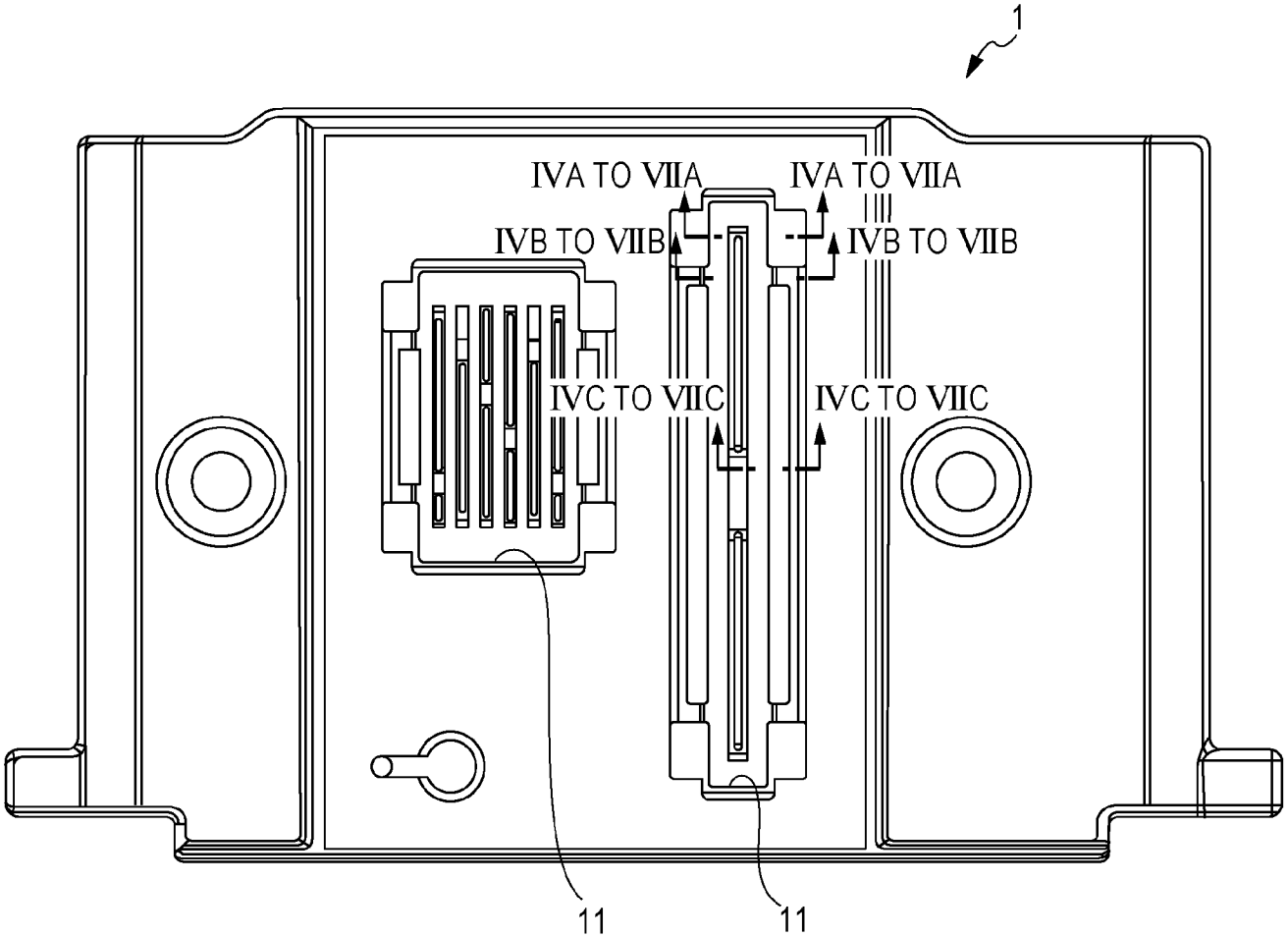
FIG. 2 is a plan view of a support member shown in FIG. 1.
Figure 3A:
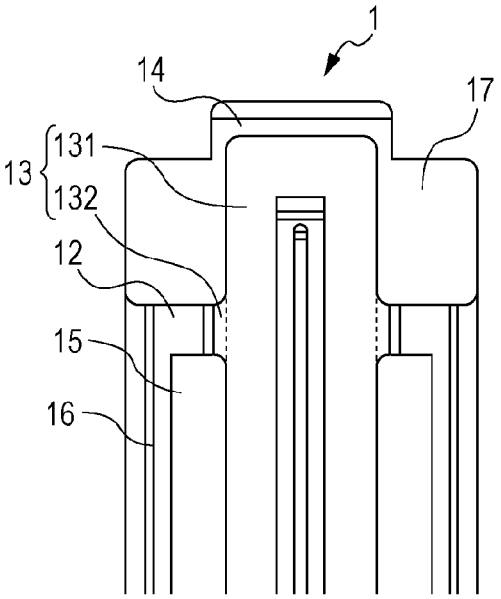
FIGS. 3A to 3C are plan and perspective views showing part of FIG. 2 in an enlarged manner.
Figure 3B:
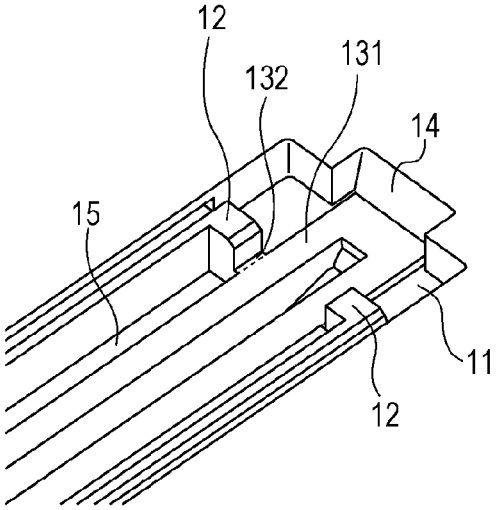
Figure 3C:
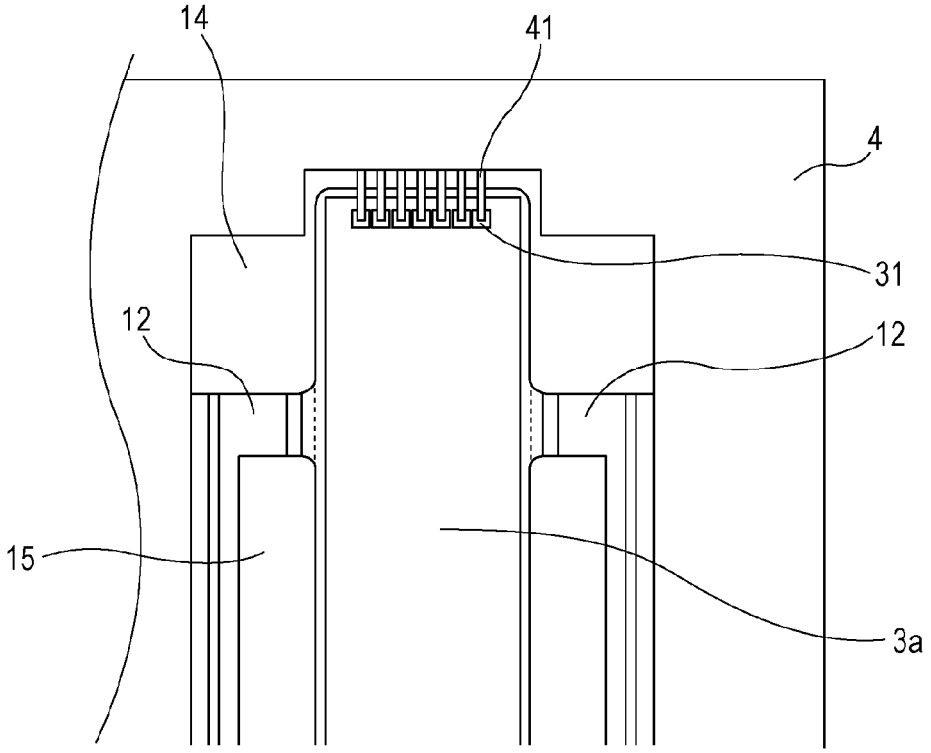

A configuration of the support member 1 is described with reference to FIGS. 2 and 3A to 3C. FIG. 2 is a plan view of the support member 1. FIG. 3A is a plan view showing part of the support member 1 shown in FIG. 2 in an enlarged manner. FIG. 3B is a perspective view showing part of the support member 1 in an enlarged manner. FIG. 3C is a plan view showing a state in which the recording element substrate 3*a* and the electric wiring member 4 are bonded to the support member 1.

The recording element substrates 3*a* and 3*b* are bonded to the support member 1 by applying an adhesive to the support member 1 and then aligning the positions of the recording element substrates 3*a* and 3*b*. Also, the electric wiring member 4 is bonded to the support member 1 with another adhesive that is different from the adhesive used when the recording element substrates 3*a* and 3*b* are bonded.

The support member 1 is formed by resin-molding. A filler is blended by 40% by mass to a resin material (modified polyphenylene ether) used in this embodiment to increase rigidity and to cause the coefficient of linear expansion to become near the coefficient of linear expansion of the recording element substrate. The support member 1 has recesses 11 at arrangement portions where the recording element substrates 3*a* and 3*b* are respectively arranged. The recesses 11 are more recessed as compared with portions which surround the arrangement portions and to which the electric wiring member 4 is bonded. This configuration is to cause an inner lead 41 of the electric wiring member 4 and connection terminals 31 of the recording element substrates 3*a* and 3*b* to have substantially the same heights and to improve reliability of the electric connection part of both.

As shown in FIGS. 3A to 3C, a projection-shaped adhesive application surface 13 is formed at a center portion of the bottom surface of the recess 11 that houses the recording element substrate 3*a*. The recess 11 has a projection 12 projecting inward from an inner side surface of the recess. The adhesive application surface 13 includes a first region 131 and a second region 132. The first region 131 is a bonding region with respect to the recording element substrate 3*a*, and is covered with the back surface of the recording element substrate 3*a*. The second region 132 is a region extending from the first region 131 to the projection 12. In this embodiment, a portion, which is included in a peripheral edge portion of the second region 132 and contacts the projection 12, has a length being the same as the width of the projection 12.

A wall (not shown in FIGS. 3A to 3C) is formed on the second region. The wall closes the gap between the projection 12 and the side surface of the recording element substrate 3*a* facing the projection 12. With this wall, the periphery of the adhesive application surface 13 within the recess is divided into a connection-part near region 14 and an element-substrate lateral region 15. The connection-part near region 14 is a region sandwiching an electric connection part between the connection terminal 31 and the inner lead 41 (a region near the electric connection part). The element-substrate lateral region 15 is a region being far from the electric connection part as compared with the connection-part near region 14. The bottom surface of the element-substrate lateral region 15 is more recessed as compared with the bottom surface of the connection-part near region 14.

Also, a portion projecting in a direction toward the recording element substrate 3*a* and having the same height as those of two projections 12 is provided between the two projections 12 located at both ends of the element-substrate lateral region 15. With the portion and the projections 12, the element-substrate lateral region 15 has an angular C shape. A groove 16 is provided in an upper portion of the portion.

In this embodiment, the above-described respective portions of the support member 1 are integrally formed by injection molding. Also, the structure of the recess 11 that houses the recording element substrate 3*b* is similar to the structure of the recess 11 that houses the recording element substrate 3*a*.

A manufacturing method of the liquid ejection head 10 according to this embodiment is described below. In particular, the method is described from a bonding step of bonding the recording element substrate 3*a* to the support member 1 to a sealing step of sealing the electric connection part. A bonding step and a sealing step of the recording element substrate 3*b* are similar to those of the recording element substrate 3*a*, and hence the description is omitted.

FIGS. 4A to 7D are illustrations for describing manufacturing steps of the liquid ejection head 10 according to this embodiment. FIGS. 4A, 5A, 6A, and 7A are cross-sectional views respectively taken along lines IVA-IVA, VA-VA, VIA-VIA, and VIIA-VIIA in FIG. 2A. FIGS. 4B, 5B, 6B, and 7B are cross-sectional views respectively taken along lines IVB-IVB, VB-VB, VIB-VIB, and VIIB-VIIB in FIG. 2A. FIGS.

4C, 5C, 6C, and 7C are cross-sectional views respectively taken along lines IVC-IVC, VC-VC, VIC-VIC, and VIIC-VIIC in FIG. 2A. FIGS. 4D, 5D, 6D, and 7D are plan views showing application loci and spread of an adhesive. In FIGS. 4D, 5D, 6D, and 7D, the illustration of the recording element substrate 3*a* and the electric wiring member 4 that are bonded to the support member 1 is omitted.

First, an adhesive 5 is applied to the projection-shaped adhesive application surface 13 provided at the support member 1 (see FIGS. 4A to 4D). In this embodiment, a thermosetting adhesive is applied to the first region 131 by needle scanning (see FIG. 4D). The applied adhesive 5 spreads within the first region 131 (see FIGS. 5A to 5D). The spread of the adhesive 5 is stopped at the peripheral edge portion of the first region 131. Also, the adhesive 5 applied to the first region 131 spreads in the second region 132, and reaches the projection 12. Then, the spread adhesive 5 stops at a portion contacting the projection 12 of the second region 132. In this embodiment, the adhesive application surface 13 is formed in a projection shape. In other words, the periphery of the adhesive application surface 13 is more recessed as compared with the adhesive application surface 13. Accordingly, in the applying step of the adhesive 5, the adhesive 5 that covers both the first region 131 and the second region 132 hardly spreads to the outside of the regions. Consequently, the adhesive 5 does not spread to the entire bottom surface of the recess 11 but selectively spreads toward the projection 12. Accordingly, the use amount of the adhesive 5 can be restricted to the minimum required amount.

Figure 4A:
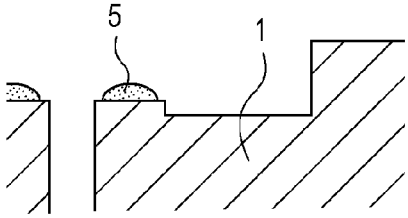
FIGS. 4A to 4D are illustrations showing an applying step an adhesive.
Figure 4B:
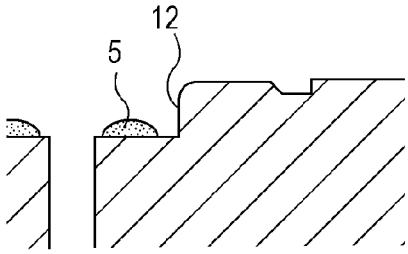
Figure 4C:
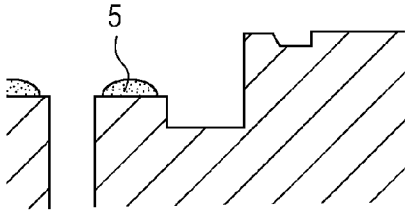
Figure 4D:
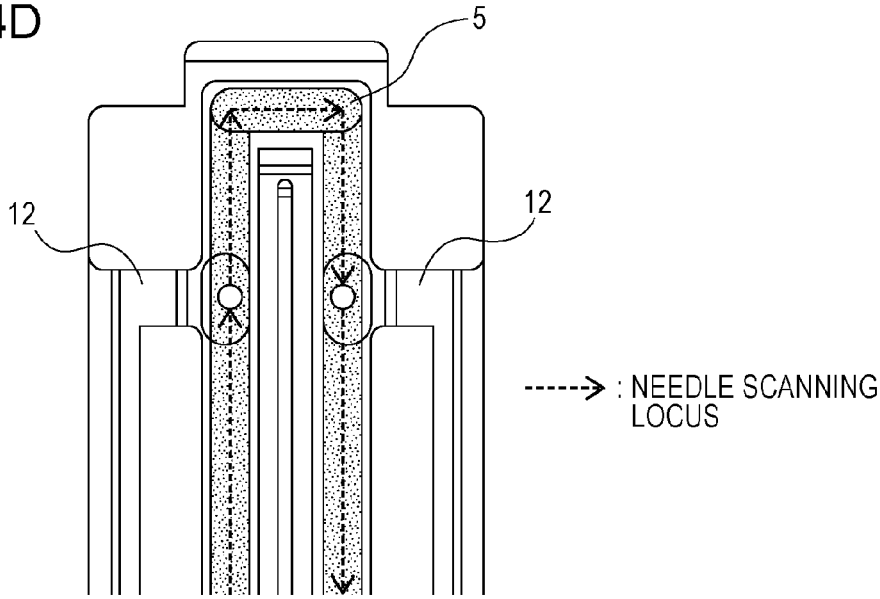
Figure 5A:
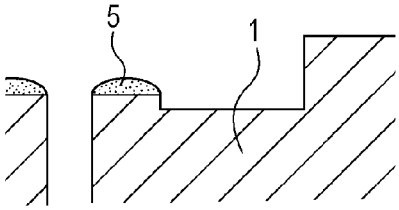
FIGS. 5A to 5D are illustrations showing motion of the adhesive in the applying step.
Figure 5B:
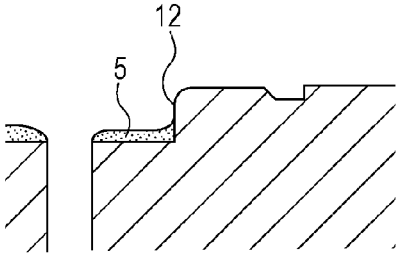
Figure 5C:
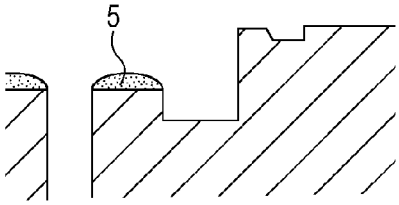
Figure 5D:
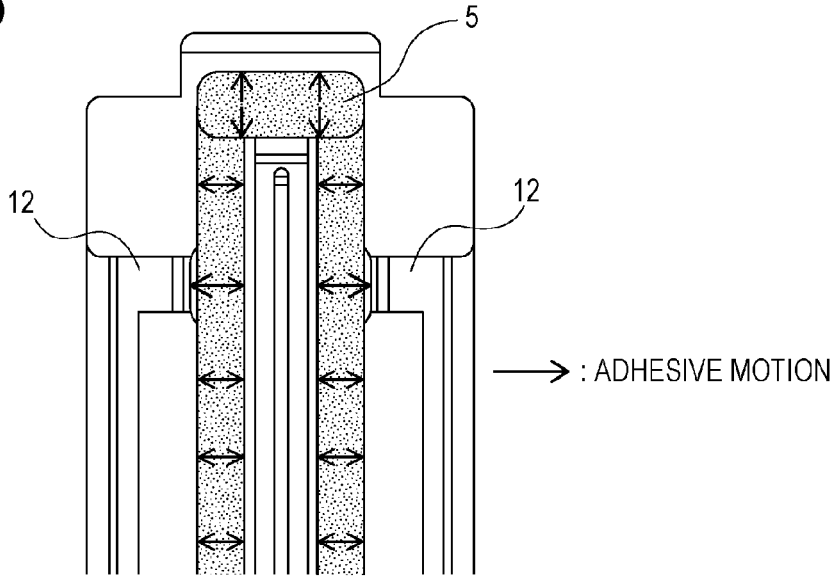
Figure 6A:
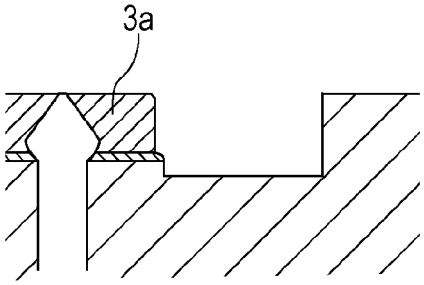
FIGS. 6A to 6D are illustrations showing a step of forming a wall of the adhesive.
Figure 6B:
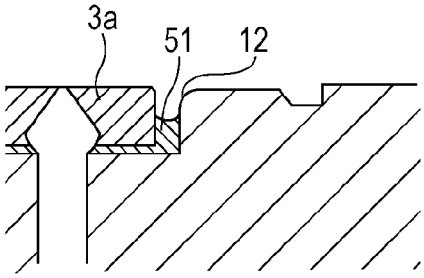
Figure 6C:
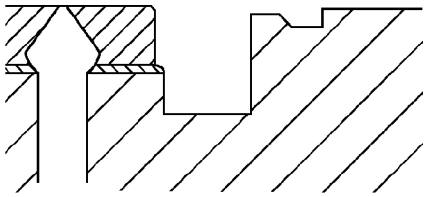
Figure 6D:
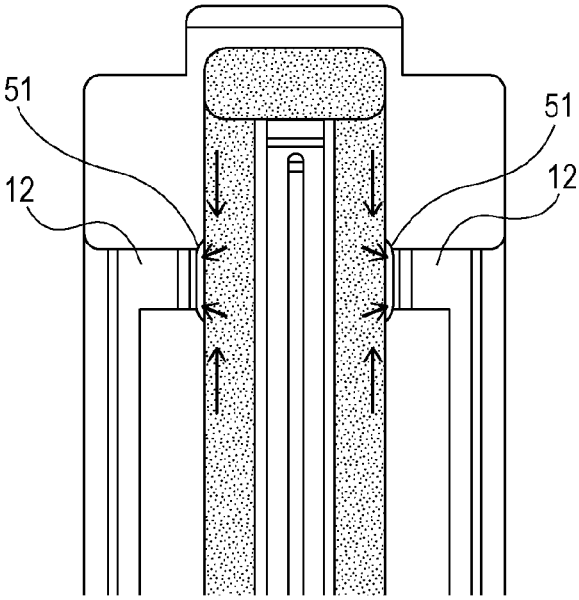
Figure 7A:
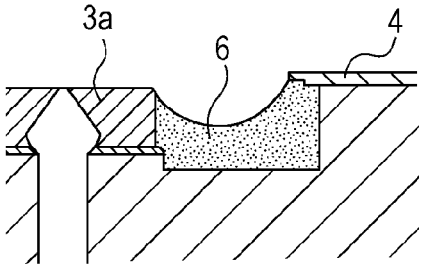
FIGS. 7A to 7D are illustrations showing a sealing step.
Figure 7B:
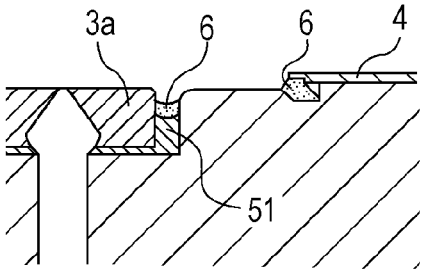
Figure 7C:
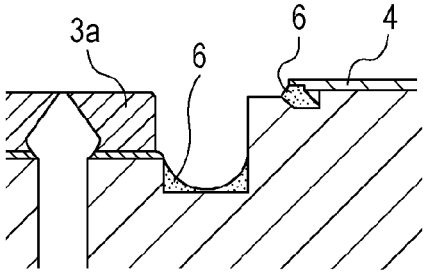
Figure 7D:
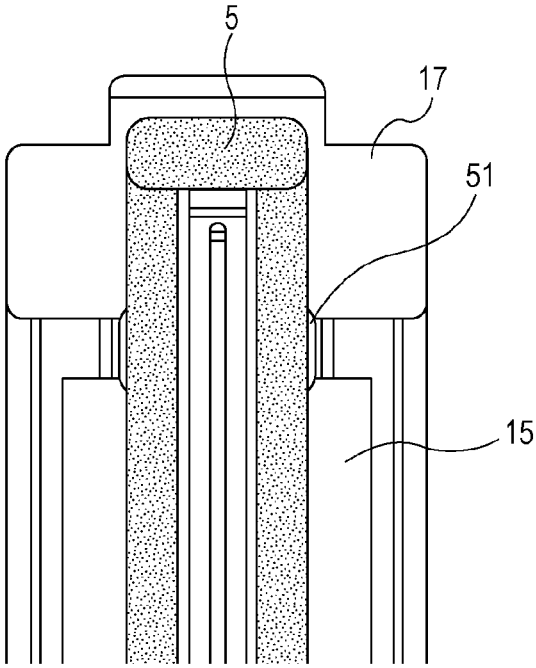

In the applying step according to this embodiment, a needle is stopped for a predetermined period at a portion facing the projections 12 within the first region 131 to ensure the height of the wall by a certain degree (described later) and hence the application amount of the adhesive 5 at the portion is increased (see FIG. 4D). However, the stop period for the needle may not be provided in accordance with the required height of the wall. Also, in this embodiment, the needle scans only in the first region 131; however, the needle may scan in the second region 132 and apply the adhesive 5.

Next, the recording element substrate 3*a* is arranged while being positioned at the recess 11 of the support member 1 by handling the recording element substrate 3*a* with use of a jig (see FIGS. 6A to 6D). At this time, the adhesive 5 applied to the first region 131 is pushed out of the recording element substrate 3*a* from the lower surface of the recording element substrate 3*a* because the adhesive 5 is pressed by the recording element substrate 3*a*. The adhesive 5 that is pushed out and flows to the second region 132 moves upward by a capillary force acting between the projection 12 and the side surface of the recording element substrate 3*a* facing the projection 12. A meniscus force acts on the adhesive 5 pushed out to a region except the second region 132 at the peripheral edge portion of the adhesive application surface 13, and hence the adhesive 5 does not extend to the outside of the plane and moves in the plane. Consequently, the adhesive 5 pushed out by the recording element substrate 3*a* is gathered in the second region 132, and the height of the adhesive 5 in the second region 132 becomes high, and the adhesive 5 forms a wall 51 (see FIG. 6B).

In this embodiment, the adhesive 5 with low thixotropic properties is used, and the adhesive 5 reaches the projection 12 before the arrangement of the recording element substrate 3*a*. However, according to the invention, the adhesive 5 with low thixotropic properties may be used and the adhesive 5 may reach the projection 12 when pressed by the recording element substrate 3*a*. Also in this case, with the projection-shaped adhesive application surface 13, the adhesive 5 pushed out by the recording element substrate 3*a* selectively spreads toward the projection 12, and hence a wall 51 can be formed without using the adhesive 5 by a large amount.

After the recording element substrate 3*a* is mounted on the support member 1, the electric wiring member 4 is bonded to the support member 1, and the connection terminal 31 of the recording element substrate 3*a* and the inner lead 41 of the electric wiring member 4 are electrically connected with each other.

Then, to protect the inner lead 41 from liquid such as ink or an external force, a sealant 6 is injected (see FIGS. 7A to 7D). The sealant 6 is injected from a pocket 17 shown in FIG. 7D. After the injection, the sealant 6 flows into the following two regions by a capillary force. One of the regions is a region between the side surface of the recording element 3 near the connection terminal 31 (a side surface near a short side portion) and the inner side surface of the recess 11. The other region is a region between the groove 16 and the electric wiring member 4. At this time, since the wall 51 is formed between the pocket 17 and the element-substrate lateral region 15, the spread of the sealant 6 is stopped at the wall 51. If the height of the sealant 6 injected to the pocket 17 is higher than the wall 51, the sealant 6 may be going to cross the wall 51. However, the distance between the recess 11 of the element-substrate lateral region 15 and the recording element substrate 3*a* is larger than the distance between the projection 12 of the support member 1 and the recording element substrate 3*a*. Hence, the sealant 6 forms a meniscus at the projection 12, and the inflow amount of the sealant 6 to the element-substrate lateral region 15 is restricted to a small amount. Also, even if the meniscus is broken and the sealant 6 flows into the element-substrate lateral region 15, since the bottom surface of the element-substrate lateral region 15 is more recessed as compared with the bottom surface of the connection-part near region 14, the height of the sealant 6 from the bottom surface is sufficiently low with respect to the height of the recording element substrate 3*a*. That is, the contact area between the sealant 6 and the recording element substrate 3*a* is sufficiently small. Also, in this embodiment, an opening end of the electric wiring member 4 provided to allow the recording element substrate 3*a* to be exposed is located at the inner side with respect to an opening end of the recess 11 of the support member 1. In particular, in the element-substrate lateral region 15, the opening end to allow the recording element substrate 3*a* to be exposed is located directly above the groove 16. With this positional relationship, the sealant 6 can be interposed in the region between the groove 16 and the electric wiring member 4. Accordingly, reliability of bonding of the electric wiring member 4 can be increased.

Then, a second sealant (not shown) is applied onto the inner lead 41 to protect the electric connection part between the inner lead 41 and the connection terminal 31 from liquid such as ink or an external force. In this embodiment, the sealing step is divided into a step of filling a lower space of the inner lead 41 with the sealant and a step of covering an upper portion of the inner lead 41 with the sealant. However, according to the invention, these steps may be performed simultaneously.

Finally, the support member 1 is placed under a high temperature environment for a predetermined period, and hence the adhesive 5 and the sealant 6 are hardened with heat (thermally set). The viscosity of the adhesive 5 is decreased in a period from heating to hardening (setting), and becomes likely movable. However, since the adhesive application surface 13 is formed in a projection shape, the adhesive 5 hardly spreads out from the adhesive application surface. Accordingly, since the height of the wall 51 can be ensured without use of the adhesive 5 by a large amount, the expansion of the sealant 6 to the element-substrate lateral region 15 can be restricted.

Comparative Example

Figure 8A:
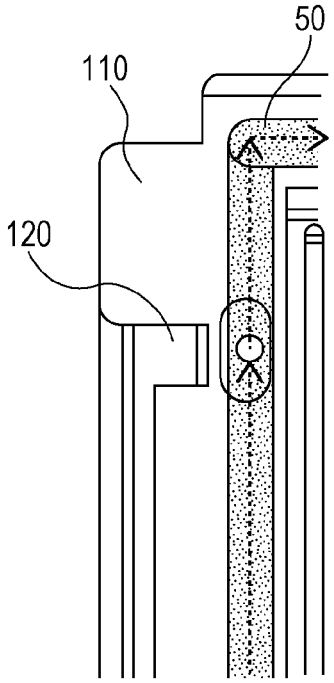
FIGS. 8A to 8C are illustrations showing motion of an adhesive according to a comparative example.
Figure 8B:
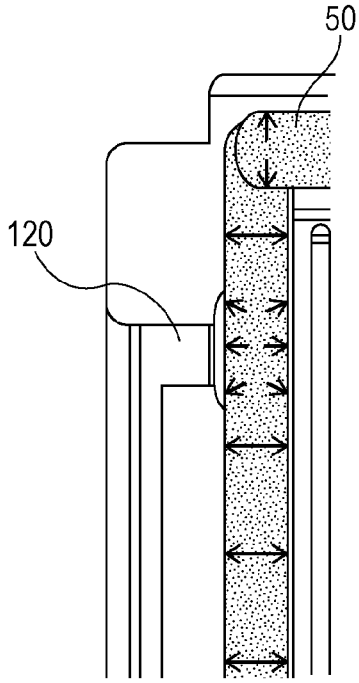
Figure 8C:
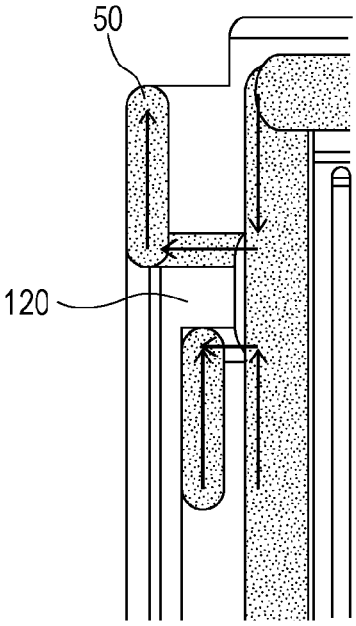

A comparative example is described with reference to FIGS. 8A to 8C. In this comparative example, the entire bottom surface of a recess 110 is a flat surface. The behavior of an adhesive is mainly described below. FIGS. 8A to 8C illustrate states of behaviors of an adhesive applied to the bottom surface of the recess 11. In this comparative example, an adhesive 50 is applied to a portion of an adhesive application surface facing a projection 120 by a larger amount than the amount of adhesive applied to other portion (see FIG. 8A). In this comparative example, since the entire bottom surface of the recess 110 is a flat surface, the adhesive 50 expands isotropically, and becomes a shape extending by a width equal to or larger than the width of the projection 120 (see FIG. 8B). Also, when the adhesive 50 reaches the projection 120, the adhesive 50 extends on the inner side surface of the recess 110 by a capillary force along a corner portion at the bottom of the projection 120 (boundary line between the bottom surface of the recess 11 and the projection 120). Hence, a large amount of adhesive is required to bond the recording element substrate and the support member and to ensure the height of the adhesive required for restricting the extension of the sealant.

In contrast, with this embodiment, the adhesive 5 pushed out from the first region 131 is promoted to move to the formation portion of the wall 51 by the projection-shaped adhesive application surface 13. Hence, since the adhesive 5 can be prevented from flowing out to a portion that does not contribute to the formation of the wall 51, the extension of the sealant 6 can be restricted while the use amount of adhesive 5 is restricted.

In this embodiment, the projection 12 is provided only at a portion facing a long side portion of the recording element substrate 3*a* (a side portion where the connection terminal 31 is not arranged). However, according to the invention, the projection 12 may be provided at a position facing a short side portion of the recording element substrate 3*a* (a side portion where the connection terminal 31 is arranged).

Also, an ink storage portion (not shown) can be removably mounted on the liquid ejection head 10 according to this embodiment. However, the invention can be applied to a form in which a liquid ejection head and an ink storage portion are integrally formed.

Modifications

Modifications of the above-described embodiment are described below with reference to FIGS. 9A to 10.

In the above-described liquid ejection head 10, as shown in FIG. 3A, the portion, which is included in the peripheral edge portion of the second region 132 and contacts the projection 12, has the length being the same as the width of the projection 12, and the center of the boundary line between the first region 131 and the second region 132 is aligned with the center of the projection 12. With this configuration, the advancement (spread) of the adhesive 5 flowing from the first region 131 to the second region 132 can be reliably stopped by the distal end surface of the projection 12 (the surface facing the recording element substrate 3*a*), the wall 51 can be stably formed. However, if such a configuration is difficult due to the limitation of manufacturing, the following configuration may be employed.

Figure 9A:
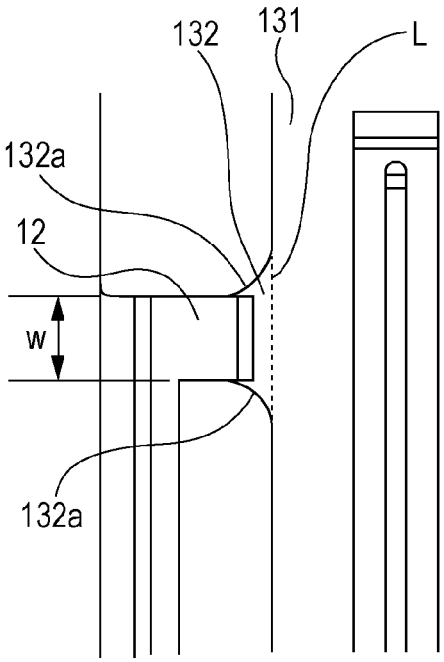
FIGS. 9A to 9C are illustrations showing a modification of the liquid ejection head shown in FIG. 1.
Figure 9B:
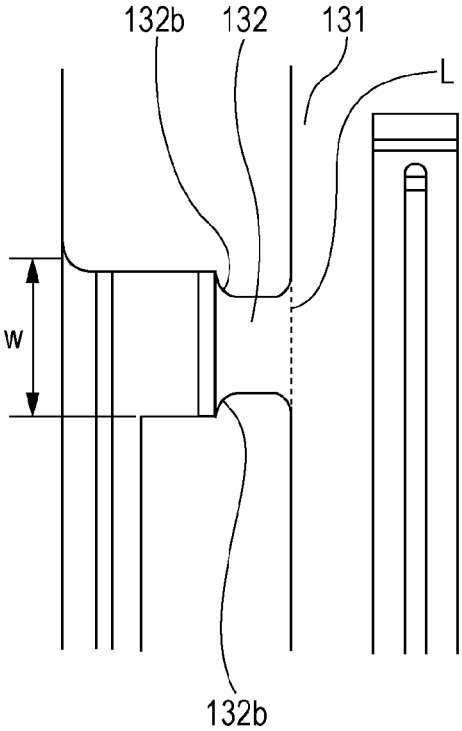
Figure 9C:
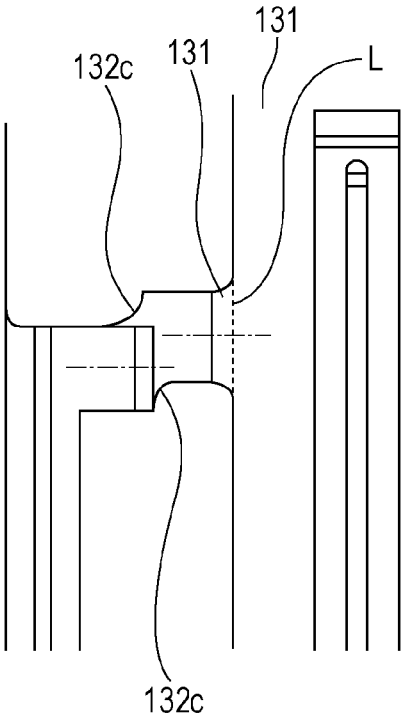
Figure 10:
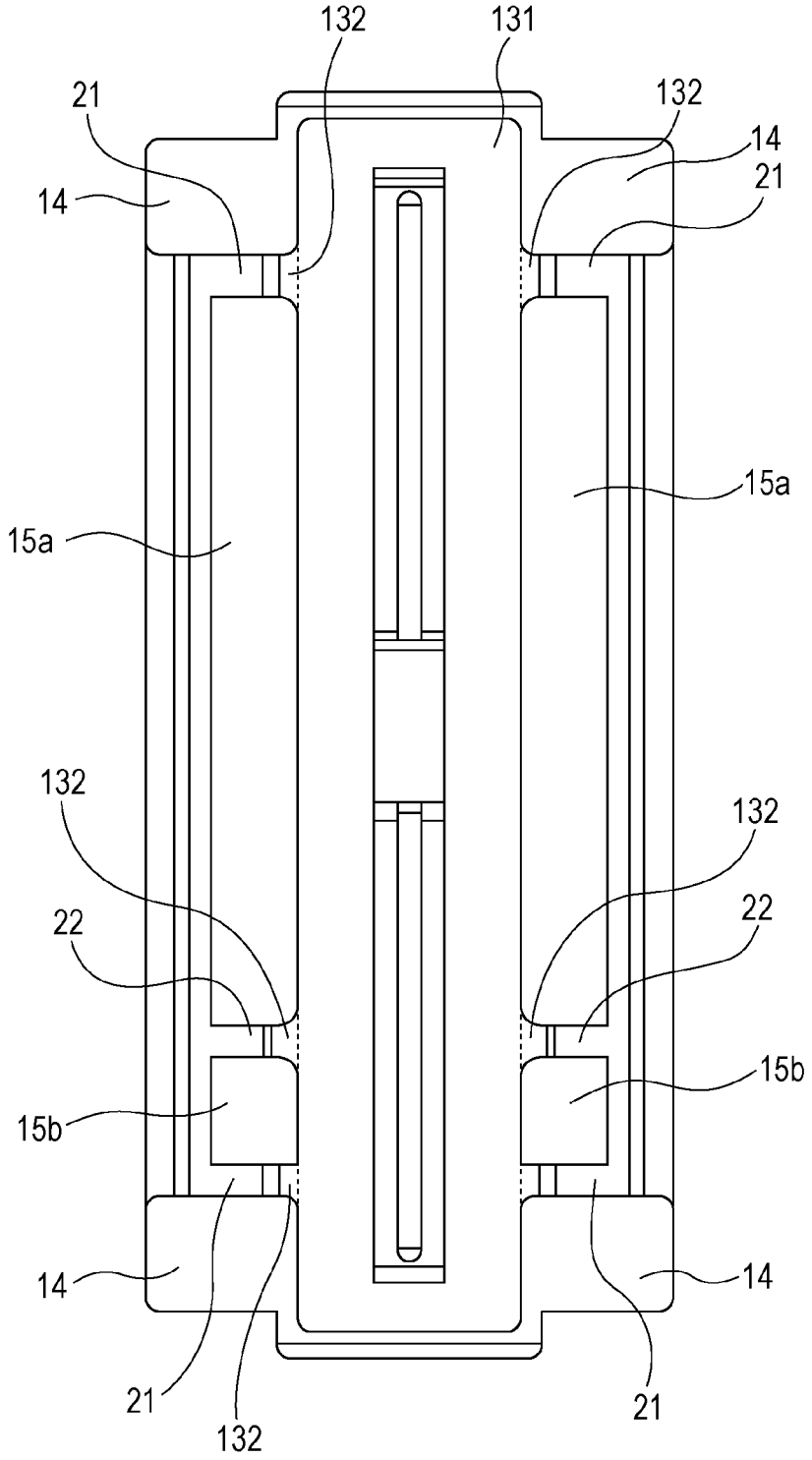
FIG. 10 is an illustration showing another modification of the liquid ejection head shown in FIG. 1.

FIG. 9A illustrates a configuration in which a boundary line L between the first region 131 and the second region 132 is larger than a width W of the projection 12. FIG. 9B illustrates a configuration in which a boundary line L is smaller than a width W of the projection 12. FIG. 9C illustrates a configuration in which the center of a boundary line L is deviated from the center of the projection 12 in the width direction of the projection 12. In any of the configurations illustrated in FIGS. 9A to 9C, the length of the portion of the second region 132 contacting the projection 12 is not the same as the width of the projection 12. Hence, if an angular corner portion is formed at a portion, which is included in the peripheral edge portion of the second region 132 and is adjacent to a portion contacting the projection 12, the adhesive 5 pushed out from the first region 131 may spread from the angular corner portion to the periphery of the adhesive application surface 13 by a capillary force. In this case, a situation may occur in which the amount of adhesive 5 that contributes to the formation of the wall 51 is insufficient. To avoid such a situation, in the case of any of the configurations illustrated in FIGS. 9A to 9C, curved portions 132*a* to 132*c* are formed at the corresponding portion, which is included in the peripheral edge portion of the second region 132 and is adjacent to the portion contacting the projection 12.

Also, this embodiment employs the configuration in which the projection 12 and the second region 132 are formed so that the peripheral region of the first region 131 within the recess 11 is divided into the connection-part near region 14 and the element-substrate lateral region 15. However, the present invention is not limited to this configuration. For example, as shown in FIG. 10, a projection 22 and a second region 132 that divides the element-substrate lateral region 15 into a region 15*a* and a region 15*b* may be formed. That is, a plurality of projections projecting from the inner side surface of the recess 11, and a plurality of projection-shaped regions, which guide the adhesive pushed out from the recording element substrate to the projections, may be provided. In this case, the connection-part near region 14, the region 15*a*, and the region 15*b* may all have the bottom surfaces with the same depth. Alternatively, the depths of the bottom surfaces may be increased in order of the connection-part near region 14, the region 15*a*, and the region 15*b*. Even if the sealant 6 crosses the wall 51 (not shown in FIG. 10) formed between the projection 21 and the recording element substrate 3*a*, the height of the sealant 6 in the region 15*b* is lower than the connection-part near region 14. Hence, the sealant 6 hardly crosses the wall (not shown) formed between the projection 22 and the recording element substrate 3*a*. This configuration is effective as a measure of restricting the extension of the sealant 6 if the depth of the element-substrate lateral region 15 cannot be large due to a limitation such as the thickness of the support member 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-112186 filed May 30, 2014, which is hereby incorporated by reference herein in its entirety.

What is claimed is:

1. A liquid ejection head comprising:

a recording element substrate configured to eject liquid, the recording element substrate having a side surface;

an electric wiring substrate configured to be electrically connected with the recording element substrate;

a support member having a recess configured to house the recording element substrate, the recess having a bottom surface and an inner side surface; and a sealant configured to seal an electric connection part between the recording element substrate and the electric wiring substrate, wherein the support member has a projection-shaped adhesive application surface formed at the bottom surface of the recess, an adhesive being applied to the adhesive application surface, the adhesive bonding the recording element substrate, and a projection projecting from the inner side surface of the recess near the electric connection part toward the adhesive application surface, wherein the adhesive application surface has a first region configured to be covered with the recording element substrate, and a second region extending from the first region to the projection, and wherein the second region has a wall formed of part of the adhesive and configured to close a gap between the projection and the side surface of the recording element substrate facing the projection.

2. The liquid ejection head according to claim 1, wherein one of regions divided by the wall within the recess and being far from the electric connection part has a smaller height of the sealant from the bottom surface as compared with the other region near the electric connection part.

3. The liquid ejection head according to claim 1, wherein one of regions divided by the wall within the recess and being far from the electric connection part has the bottom surface being more recessed as compared with the other region near the electric connection part.

4. The liquid ejection head according to claim 1, wherein the second region has a peripheral edge portion, and a portion, which is included in the peripheral edge portion of the second region and contacts the projection, has a length being the same as a width of the projection.

5. The liquid ejection head according to claim 1, wherein a length of a boundary line between the first region and the second region is longer than a width of the projection, and wherein the second region has a peripheral edge portion, and a portion, which is included in the peripheral edge portion of the second region and is adjacent to a portion contacting the projection, has a curved portion.

6. The liquid ejection head according to claim 1, wherein a length of a boundary line between the first region and the second region is shorter than a width of the projection, and wherein the second region has a peripheral edge portion, and a portion, which is included in the peripheral edge portion of the second region and is adjacent to a portion contacting the projection, has a curved portion.

7. The liquid ejection head according to claim 1, wherein a center of a boundary line between the first region and the second region is deviated from a center of the projection in a width direction of the projection, and wherein the second region has a peripheral edge portion, and a portion, which is included in the peripheral edge portion of the second region and is adjacent to a portion contacting the projection, has a curved portion.

8. The liquid ejection head according to claim 1, wherein the projection includes a plurality of the projections and the second region includes a plurality of the second regions, and among a plurality of regions divided by a plurality of the walls respectively formed between the plurality of projections and the plurality of second regions within the recess, a region being farther from the electric connection part has a smaller height of the sealant from the bottom surface.

9. A manufacturing method of a liquid ejection head, the liquid ejection head including a recording element substrate configured to eject liquid, the recording element substrate having a side surface; an electric wiring substrate configured to be electrically connected with the recording element substrate; and a support member having a recess configured to house the recording element substrate, the recess having a bottom surface and an inner side surface, and a projection projecting from the inner side surface of the recess near an electric connection part between the recording element substrate and the electric wiring substrate toward the recording element substrate, the method comprising:

applying an adhesive to a projection-shaped adhesive application surface formed at the bottom surface of the recess, the adhesive application surface has a first region configured to be covered with the recording element substrate, and a second region extending from the first region to the projection;

pressing the adhesive applied to the first region by the recording element substrate, and forming a wall configured to close a gap between the projection and the side surface of the recording element substrate facing the projection with the adhesive pushed out from the first region by the pressing; and sealing the electric connection part with a sealant.

10. The manufacturing method of the liquid ejection head according to claim 9, wherein only the first region is covered with the adhesive in the applying step.

11. The manufacturing method of the liquid ejection head according to claim 9, wherein both the first region and the second region are covered with the adhesive in the applying step.

* * * * *